US009238573B2

(12) United States Patent
Luminet et al.

(10) Patent No.: US 9,238,573 B2
(45) Date of Patent: Jan. 19, 2016

(54) PROTECTING DEVICE FOR A USER OF AN AERIAL LIFT AND AERIAL LIFT COMPRISING SUCH A DEVICE

(71) Applicant: HAULOTTE GROUP, L'Horme (FR)

(72) Inventors: Philippe Luminet, Lyons (FR); Charles Lagoutte, Buxy (FR); Slaheddine Beji, Vienne (FR)

(73) Assignee: HAULOTTE GROUP, L'Horme (FR)

( * ) Notice: Subject to any disclaimer, the term of this patent is extended or adjusted under 35 U.S.C. 154(b) by 154 days.

(21) Appl. No.: 13/718,926

(22) Filed: Dec. 18, 2012

(65) Prior Publication Data

US 2013/0153335 A1 Jun. 20, 2013

(30) Foreign Application Priority Data

Dec. 19, 2011 (FR) ..... 11 61931

(51) Int. Cl.

| | |
|---|---|
| ***B66F 17/00*** | (2006.01) |
| ***A42B 3/04*** | (2006.01) |
| ***A41D 1/00*** | (2006.01) |
| ***B66F 11/04*** | (2006.01) |

(52) U.S. Cl.

CPC ..... *B66F 17/006* (2013.01); *A41D 1/002* (2013.01); *A42B 3/046* (2013.01); *B66F 11/04* (2013.01)

(58) Field of Classification Search

CPC .. A62B 35/0037; B66F 17/006; A42B 3/0433
USPC ..... 182/3, 4, 18; 2/2.14, 4, 905, 906, 310, 2/311, 312; 340/4.11
See application file for complete search history.

(56) References Cited

U.S. PATENT DOCUMENTS

| | | | | | |
|---|---|---|---|---|---|
| 2,473,394 | A * | 6/1949 | Scott | 340/321 |
| 4,814,632 | A * | 3/1989 | Glaeser et al. | 307/116 |
| 4,871,996 | A * | 10/1989 | Tsunamoto et al. | 340/521 |
| 5,348,008 | A * | 9/1994 | Bornn et al. | 600/301 |
| 5,390,104 | A * | 2/1995 | Fulton | 700/65 |
| 6,265,983 | B1 * | 7/2001 | Baillargeon | 340/687 |
| 6,330,931 | B1 * | 12/2001 | Baillargeon et al. | 182/18 |
| 7,192,152 | B1 * | 3/2007 | Hesse | 362/108 |
| 8,325,053 | B2 * | 12/2012 | Flynt et al. | 340/679 |
| 8,490,746 | B2 * | 7/2013 | Cummings | 182/2.2 |
| 2002/0032386 | A1 * | 3/2002 | Sackner et al. | 600/536 |
| 2005/0026688 | A1 * | 2/2005 | Goeben | 463/36 |
| 2005/0228234 | A1 * | 10/2005 | Yang | 600/300 |
| 2009/0235436 | A1 * | 9/2009 | Baldesare | 2/338 |

FOREIGN PATENT DOCUMENTS

| | | | |
|---|---|---|---|
| EP | 0 795 514 | A1 | 9/1997 |
| FR | 2 797 860 | A1 | 3/2001 |
| GB | 2 396 238 | A | 6/2004 |
| KR | 20100107839 | | 10/2010 |
| WO | WO 00/19052 | A1 | 4/2000 |
| WO | WO 2007/126435 | A2 | 11/2007 |

* cited by examiner

*Primary Examiner* — Katherine Mitchell
*Assistant Examiner* — Colleen M Chavchavadze
(74) *Attorney, Agent, or Firm* — Knobbe, Martens, Olson & Bear, LLP

(57) ABSTRACT

The device (100) according to the invention for protecting a user (U) of an aerial lift comprises a clothing element (100) designed to be worn by the user (U) and equipped with a signaling mechanism (101-103) connected to a controller (73) of the lift. Said alert means (101-103) comprise a member, such as a button (101) or a pull-tab, designed to be actuated by the user (U) to trigger an emergency stop when the user detects a potentially dangerous situation.

14 Claims, 4 Drawing Sheets

PROTECTING DEVICE FOR A USER OF AN AERIAL LIFT AND AERIAL LIFT COMPRISING SUCH A DEVICE

FIELD OF THE INVENTION

The invention relates to a device for protecting a user of an aerial lift as well as an aerial lift comprising, inter alia, such a protective device.

BACKGROUND OF THE INVENTION

It is known that a user of an aerial lift must be protected, in particular with respect to risks of impacts with obstacles located near the platform of the lift. To that end, aerial lifts for people generally have an emergency stop button placed on a control console installed on their platform, which makes it possible to react to a potentially dangerous situation. Furthermore, the safety equipment for a user of such a lift may comprise a helmet and/or a harness by which the user is connected to the platform, so as to prevent risks of falling.

A new type of aerial lift is being developed, i.e. so-called large and high-capacity aerial lifts whereof the platforms support several users. These lifts allow several operators to work at heights, in a same area. The various operators present on the same platform at a height are not all located near an emergency stop button situated on the control console.

Furthermore, in case of danger, the communication between an operator situated at a height, on the platform of an aerial lift, and one or more other people situated on the ground is sometimes difficult, due to the distance and the relatively noisy environment that may prevail on the worksite. Here again, in the event imminent danger, precious seconds may be lost.

Lastly, even in the case of a user using a relatively small lift, said user may find himself stuck on the platform, at a distance from the control console that does not allow him to actuate the emergency stop button, whereas the people on the ground do not immediately notice such a dangerous situation.

It is known from KR 2010 0107839 to equip the helmet of an aerial lift user with proximity sensors making it possible to react when the helmet collides with a beam, as shown in FIG. 2 of this document. This approach makes it possible to protect a user in case of impact, but not to react early when the user detects a dangerous situation for another person present on the platform of the lift or present on the platform of another adjacent lift.

SUMMARY OF THE INVENTION

The invention more particularly aims to resolve these drawbacks by proposing a protection device that is reliable in a large number of usage configurations.

To that end, the invention relates to a device for protecting a user of an aerial lift, said device comprising a clothing element designed to be worn by the user and equipped with a signaling mechanism connected to a controller of the lift. According to the invention, the signaling mechanism comprises a member designed to be actuated by the user to trigger an emergency stop of the lift.

Owing to the invention, each user may be equipped with a closing element continuously accessible to him, irrespective of his position on the platform, and by which he may give an alert when he detects a dangerous situation, whether it is a situation that concerns him directly or a situation that concerns another person. This is particularly suited to cases where several people are working on a same platform at a height or on adjacent lifts, on a same worksite. The user can actuate the member for triggering an emergency stop through a manual and deliberate action. He can therefore react early when a dangerous situation risks arising.

According to advantageous optional aspects of the invention, such a device may incorporate one or more of the following features, considered in any technically allowable combination:

- The closing element is a harness, vest, belt, bracelet, or helmet.
- The signaling mechanism is matched with the controller, which is specific to a lift or a group of lifts.
- The clothing element is equipped with proximity sensors capable of detecting an obstacle and sending the controller of the lift an emergency signal in the case of an imminent collision.
- The protection device is equipped with at least one sensor for monitoring the health condition of the user and, potentially, with at least one memory for storing values read by that sensor.
- The protection device is equipped with a mechanism configured to signal a detected alert situation, of the light, sound or vibration kind, and/or a device for remote voice communication.
- The protection device comprises autonomous electrical power supply for the signaling mechanism, as well as a wireless connection with the controller of the lift.
- Alternatively, the electrical power supply for the signaling mechanism and/or the transmission of information between said signaling mechanism and the controller takes place through a wired connection incorporated into a tether of the clothing element to a platform of the lift.
- The protective device comprises a device for identifying the user and/or managing the authorization levels.
- The protection device is equipped with anti-impact protection elements.
- The member designed to be actuated by the user to trigger an emergency stop of the lift is positioned in front of the user's chest.

The invention also relates to an aerial lift that comprises a chassis equipped with movement mechanism, a platform, an elevator for elevating the platform relative to the chassis, and a controller of the movement mechanism and/or elevator. This lift is characterized in that it comprises a protection device as described above whereof the signaling mechanism is connected to its controller.

BRIEF DESCRIPTION OF THE DRAWINGS

The invention will be better understood, and other advantages thereof will appear more clearly, in light of the following description of two embodiments of a protection device according to its principle, provided solely as an example and done in reference to the appended drawings, in which.

DETAILED DESCRIPTION OF THE PREFERRED EMBODIMENT

Figure 1:
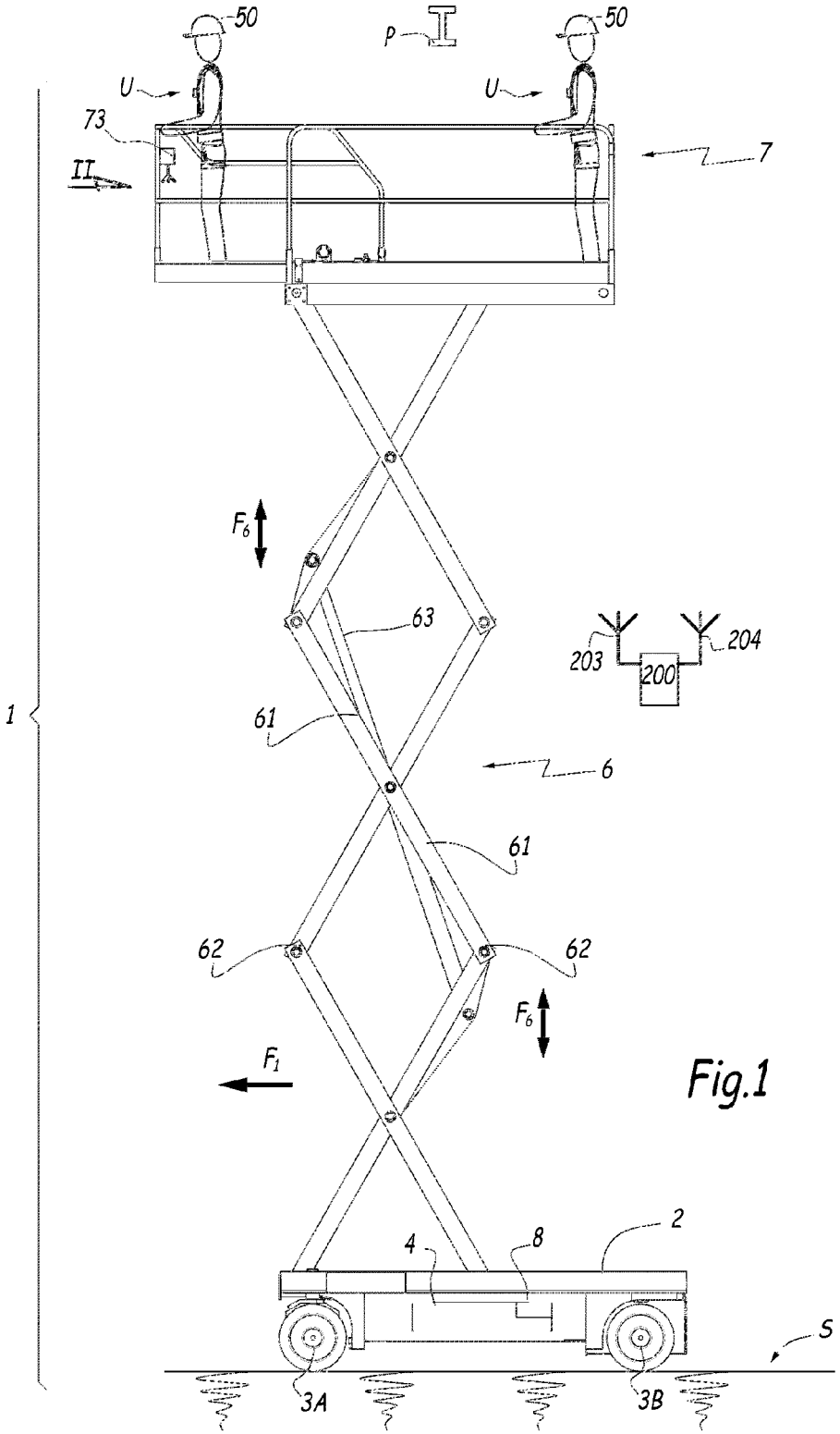
FIG. 1 is an elevation view of the lift according to the invention during use by an operator.

The lift 1 shown in FIG. 1 is equipped with a chassis 2 resting on the surface of the ground S by means of four wheels, two of which are visible in this figure with references 3A and 3B. The chassis 2 bears a motor assembly 4 with which a structure 6 commonly called a "scissor" structure is associated made up of bars 61 articulated to each other around pivots 62 and commanded by a mechanical device. Alternatively, the scissor structure 6 may be controlled by electric or hydraulic jacks. The possibility of vertical extension of the scissor structure 6 is represented by the double arrow F6. In the upper portion of the scissor structure 6, a platform 7 is provided on which one or more users U, for example two, may be present, as shown in FIG. 1.

The platform 7 comprises a floor 71 and a railing 72 that define a space in which the user U may stand. The platform 71 is also equipped with a module 73 for controlling the movements of the lift 1 on the surface of the ground S owing to the motor assembly 4 and the deployment of the scissor structure 6.

An electronic control unit 8 is integrated into the motor assembly 4 and connected to the module 73 by a wired connection (not shown) that makes it possible to convey the control orders from the module 73 to the unit 8.

Each user U wears a protective helmet 50.

According to the invention, each user U wears a harness 100 that is equipped with an emergency stop button 101 connected to a transmitter 102 coupled to an antenna 103. The transmitter 102 and the antenna 103 are incorporated into one of the straps 104 of the harness 100. The elements 101 to 103 together form a signaling mechanism within the meaning of the invention, as emerges from the following explanations.

When a user U wears his harness 100, the emergency stop button 101 is positioned in front of his chest. It is therefore continuously easily accessible to him. It is possible for the user to actuate said emergency stop button 101 by striking it with the wrist or the palm of the hand, in all positions, including when he is far away from the control module 73, as shown by the right-hand user U in FIG. 1. In this way, when the lift 1 moves in the direction of the arrow F1 in FIG. 1, i.e. toward the left of that figure, the right-hand user who is facing forward can react quickly when an obstacle, such as an I-beam P, risks colliding with the user or the railing 72, even when the left-hand user, who is steering the lift 1, has not detected that obstacle. This is also interesting in the case where it is not the user U situated on the platform 7 who is steering the movement of the lift 1, but another user, located on the ground.

To avoid interference between the harness 100 of a user of a first lift 1 and the controller of another adjacent lift, it is possible to provide that the transmitter 102 connected to the emergency stop button 101 of each harness 100 is matched with the electronic control unit 8 of the lift 1 with which the user U is working. In other words, it is possible to provide a "declaration" procedure by which the harness 100 is matched with the lift 1.

To be able to receive the signals transmitted by the antenna 103, the electronic unit 8 is provided with an antenna 83.

The transmitter 102 can also be provided to send, via its antenna 103, an emergency stop signal to the module 73, which is then equipped with a suitable antenna 733 and transmits the corresponding message to the unit 8 by the aforementioned wired connection. To implement the invention on a lift whereof the control module is not pre-equipped with a receiving antenna, an antenna similar to the antenna 733 can be connected electrically to the emergency stop button of the control module 73, using a kit sold separately.

When the lift 1 moves on a relatively large worksite, a server 200 may be installed near the lift 1 on a structure (not shown), with an antenna 203 designed to receive the signals transmitted by the transmitters 102 associated with the emergency stop buttons 101 of the harness is 100 of the various users U present on the worksite. This server 200 is then capable of recognizing the source of an alert signal and retransmitting the emergency stop signal to each affected lift and owing to a second antenna 204. Using a server 200 makes it possible to manage the various emergency stop signals emitted by the users U, for example to warn the user of an adjacent lift when an emergency stop signal has been emitted by a given user.

In the case where a server 200 is used, each harness 100 is matched with that server, as explained above relative to the electronic unit 8.

The harness 100 is equipped with a sensor 105 making it possible to monitor the health condition of the user U. The sensor may be a fall sensor, an inactivity sensor, a heart rate sensor or a location sensor relative to the lift 7. In the event an abnormal value is detected, this sensor can send the transmitter 102 an alert signal that may be transmitted to the unit 8, the module 73 and/or the server 200 as desired. Alternatively, the transmitter 102 continuously transmits the signal produced by the sensor 105. The analysis of the signal and the triggering of an alert are then done by the unit 8, the module 73 and/or the server 200.

A memory 106 is associated with the sensor 105 to store, at least temporarily, the values read by that sensor, in particular in case of an interruption in the wireless connection between the transmitter 102 and the unit 8 or the server 200. Storing the values read by the sensor 105 also allows a posteriori exploitation of those values, like an airplane "black box."

The harness 100 is equipped, at the user's shoulders, with two warning devices 107 which, when activated, vibrate and/or emit a light and/or sound signal, so as to warn the user U of a potentially dangerous situation. This may be the case when another user of the aerial lift 1 has activated his emergency stop button 101. This implies that the electronic control unit 8, the module 73 or the server 200 can emit a signal to the harness 100 to activate the warning devices 107 and is equipped with means, not shown here, for receiving and processing such a signal.

Alternatively or complementarily, the warning devices 107 may be provided to be activated and to emit a particular light signal when the user U has activated the emergency stop button 101 of his harness 100. This allows other people present on worksite to identify the user who has detected a danger or who is in danger himself.

According to another aspect of the invention that is not shown in the figures, the harness 100 may be equipped with a remote voice communication device, of the walkie-talkie type, which makes it possible to establish a practically immediate oral connection in the event an emergency situation is detected and the button 101 of the harness 100 is activated.

According to another aspect of the invention that is not shown, the harness 100 may also be equipped with proximity sensors capable of detecting an obstacle such as the beam P and automatically sending the transmitter 102 an emergency signal in the event of an imminent collision, said emergency signal then being automatically sent to the unit 8, the module 73 or the server 200.

Figure 2:
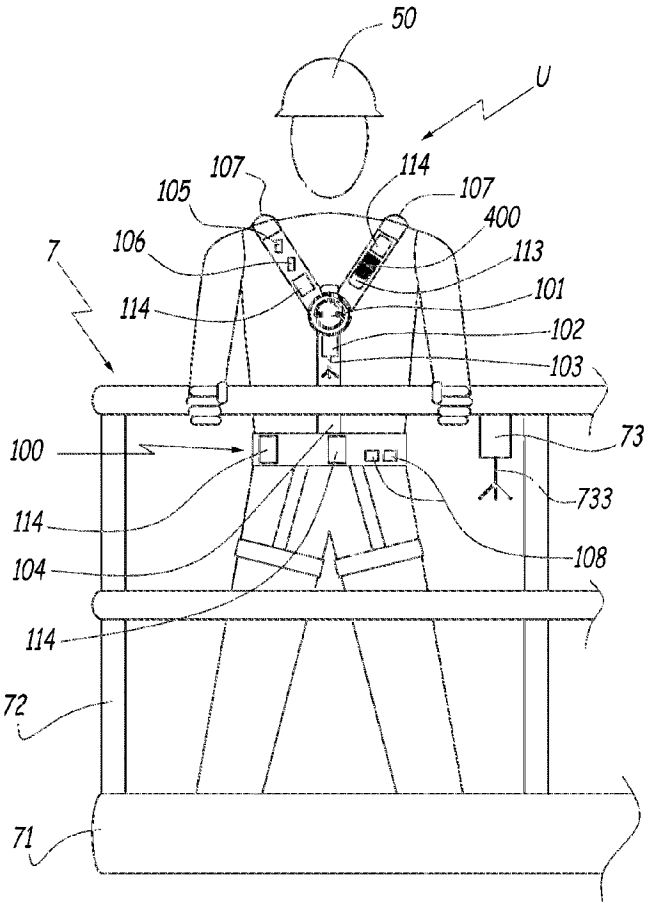
FIG. 2 is an enlarged view, in the direction of the arrow II in FIG. 1, of the operator positioned on the platform of the lift of FIG. 1.

According to another aspect the invention that is shown in FIG. 2, the harness 100 may be equipped with anti-impact protection, such as absorbent pads 114, to protect the user from the impact with an obstacle such as the beam P or the railing 72 in the event the lift 1 stops abruptly.

The harness 100 is provided with one or more rechargeable batteries 108 making it possible to electrically power the button 101, the transmitter 102 and the various sensors described above.

Figure 3:
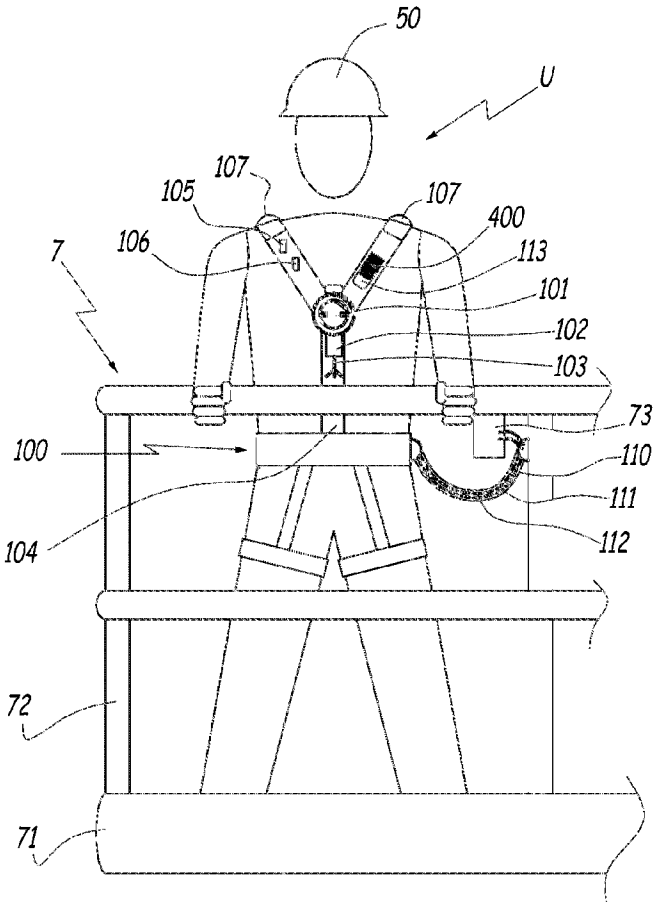
FIG. 3 is a view similar to FIG. 2 of a second embodiment of the invention.

In the second embodiment of the invention shown in FIG. 3, the elements similar to those of the first embodiment bear the same references. Hereafter, we will only describe how this embodiment differs from that previously described.

In this embodiment, the harness 100 is connected to the railing 72 by a tether or strap 110 that serves as a tether device for tethering the user U on the platform 7.

Electrical conductors 111 and 112 are incorporated into the tether 110 and make it possible on the one hand to supply the harness 100 with the electrical current from the module 73, and on the other hand to convey an electrical signal emitted by the transmitter 102 to the module 73 or the control unit 8. In that case, a complementary security function may be provided according to which the movement of the lift 1 or the actuation of the parallelogram structure 64 are only possible when the tether 110 is attached to the railing 72 and the conductors 111 and 112 are correctly connected to the module 73.

Irrespective of the embodiment, the harness 100 may be equipped with a pouch 113 designed to receive an identification card 400 of the user U. This pouch makes it possible to "customize" the harness 100 and thereby manage the authorization levels for maneuvering the lift 1. For example, if the user U who has inserted his identification card into the pouch 113 does not hold a license to drive the lift 1 and if he is the only one onboard the platform 7, then his control orders to move the lift 1 may be ignored. The user's identification card 400 may be of the RFID type or another type.

Other means for identification of the user by the harness 100 may be provided, for example inputting a code on a keypad or other means. In any case, matching the harness 100 with the unit 8 or with the server 200 makes it possible to identify the user and manage the authorization levels of several users. For example, if the only user situated in the immediate vicinity of the control module 73 does not have permission to move the lift 1, the commands from the module 73 may be deactivated.

The invention is described above in the case where the member 101 designed to be actuated by the user to trigger an emergency stop is an emergency stop button, i.e. a member that is activated by an impact or pressure, in particular by striking it with the wrist or the palm of the hand. Alternatively, this member may be of the "pull-tab" type, i.e., designed to be actuated by exerting a pulling force, using an approach comparable to that used to release a parachute. Other types of similar members may be considered. In any case, these members are designed to be actuated or maneuvered by hand and deliberately by the user.

Figure 5:
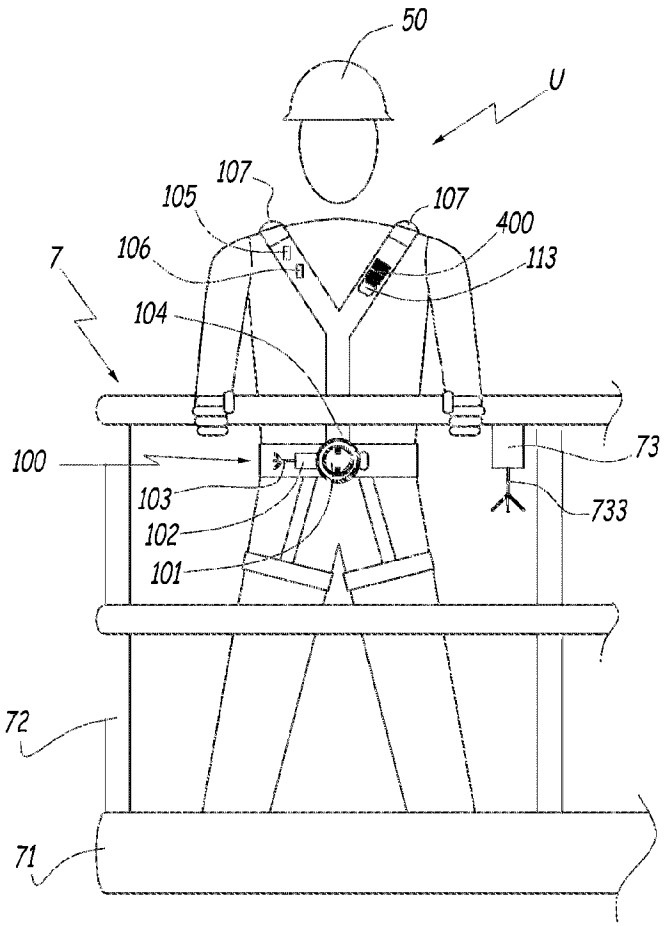
FIG. 5 depicts an embodiment where member 101 is located on a belt.
Figure 4:
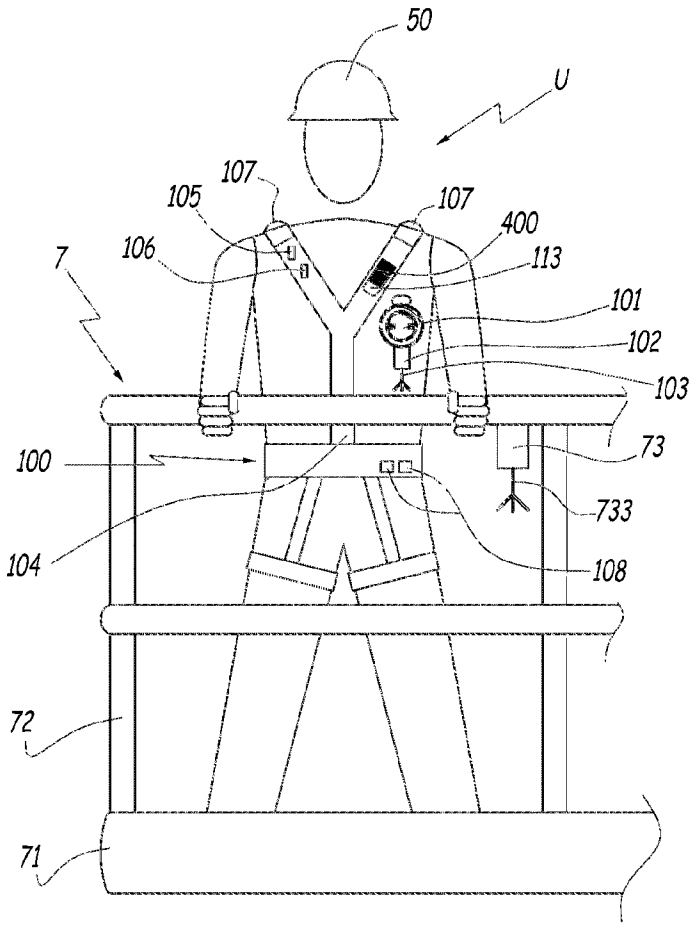
FIG. 4 depicts an embodiment where member 101 is located on a vest.
Figure 7:
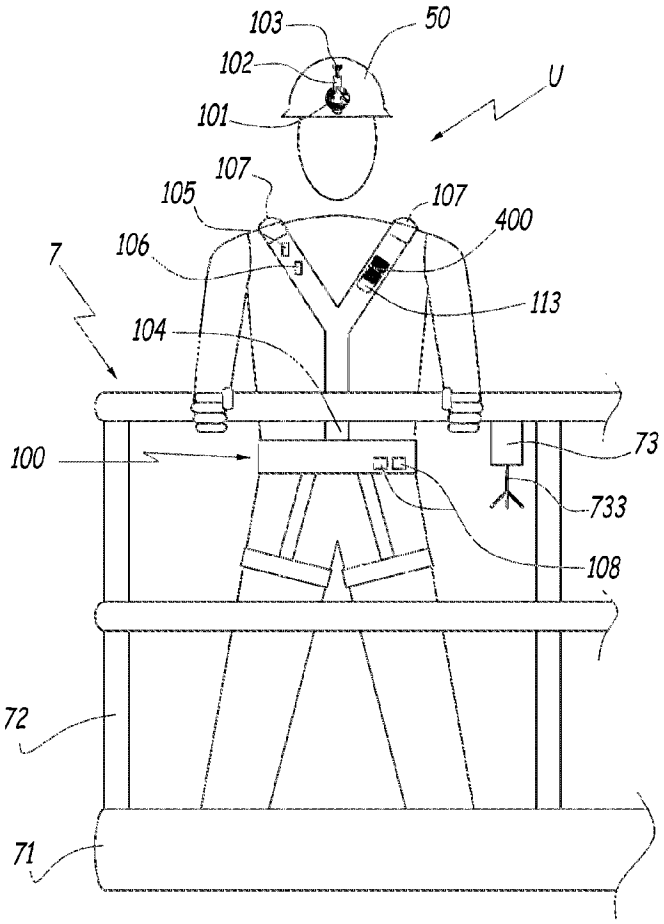
FIG. 7 depicts an embodiment where member 101 is located on a helmet.
Figure 6:
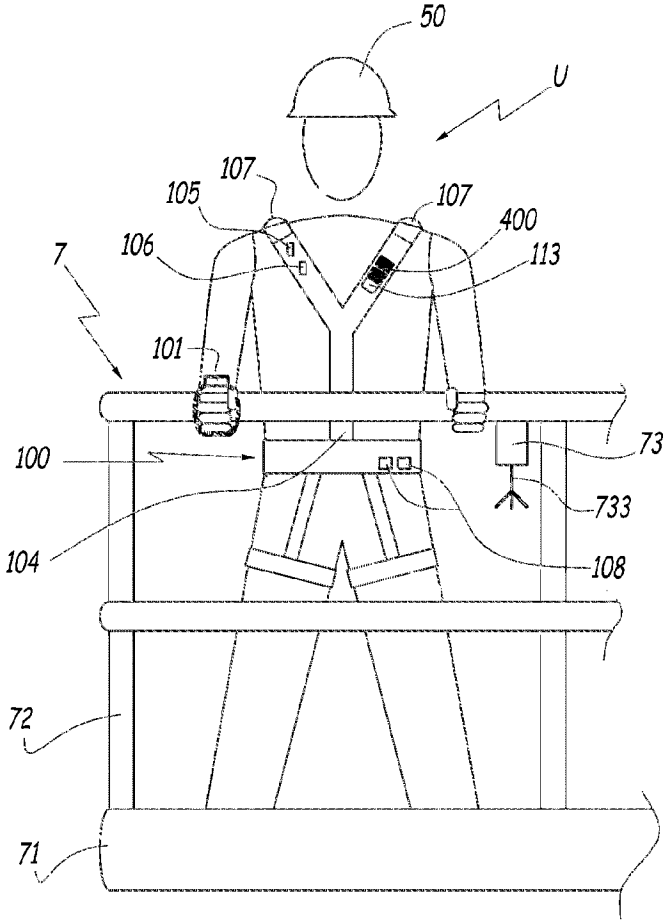
FIG. 6 depicts an embodiment where member 101 is located on a bracelet.

The invention is shown in FIGS. 2 and 3, when it is implemented with a harness 100. It may also be implemented with other clothing items, for example a vest, as shown in FIG. 4; a belt, as shown in FIG. 5; a bracelet, as shown in FIG. 6; or a helmet 50 as shown in FIG. 7.

The invention is shown in the figures in the case where the lift is of the scissor type. It is also applicable to any other aerial lift, in particular of the telescoping, vertical or hinged mast type.

The technical features of the embodiments and alternatives considered above may be combined with each other.

The invention claimed is:

1. A device for protecting a user of an aerial lift, said device comprising an element configured to be worn by the user and equipped with a signaling mechanism connected to a controller of the lift, wherein the signaling mechanism comprises a member configured to be actuated by the user to trigger an emergency stop of the lift, wherein the member is to be actuated by the user to send an alert signal in order to trigger an emergency stop of the lift, such that actuation of said member doesn't effect any physical connection of the said element to said aerial lift.

2. The device according to claim 1, wherein the element configured to be worn by the user is a harness, vest, belt, bracelet, or helmet.

3. The device according to claim 1, wherein the signaling mechanism is matched with the controller, which is specific to a lift or a group of lifts.

4. The device according to claim 1, wherein the element configured to be worn by the user is equipped with proximity sensors configured to detect an obstacle and to send to the controller of the lift an emergency signal in the case of an imminent collision.

5. The device according to claim 1, wherein said device is equipped with at least one sensor for monitoring a health condition of the user.

6. The device according to claim 1, wherein said device is equipped with a component configured to signal an emergency situation, the component being a light component, a sound component, a vibration component, or a component configured for remote voice communication.

7. The device according to claim 1, wherein said device comprises an autonomous electrical power supply for the signaling mechanism, as well as a wireless connection with the controller of the lift.

8. The device according to claim 1, wherein an electrical power supply for the signaling mechanism or transmission of information between said signaling mechanism and the controller is connected to or takes place through a wired connection incorporated into a tether of the clothing element to a platform of the lift.

9. The device according to claim 1, wherein said device comprises a mechanism for identifying the user or managing authorization level of the user.

10. The device according to claim 1, wherein said device is equipped with anti-impact protection elements.

11. The device according to claim 1, wherein the member designed to be actuated by the user to trigger an emergency stop of the lift is capable of being positioned adjacent to a user's chest.

12. An aerial lift that comprises a chassis equipped with a platform, an elevator for elevating the platform relative to the chassis, and a controller of movement of the elevator, wherein said aerial lift comprises a device according to claim 1, and the signaling mechanism of the device is connected to the controller of movement of the elevator.

13. The device according to claim 5, wherein said device is further equipped with at least one memory for storing values read by the at least one sensor.

14. The device according to claim 1, wherein the member is an emergency stop button.

* * * * *